United States Patent [19]

Kronman

[11] 4,382,539

[45] May 10, 1983

[54] TWO-WAY ENVELOPES WITH RETURN FLAP POSITIONING MEANS AND METHOD

[76] Inventor: Albert F. Kronman, Parish Dr., Locust Valley, N.Y. 11560

[21] Appl. No.: 271,392

[22] Filed: Jun. 8, 1981

[51] Int. Cl.[3] ..... B65D 27/06; B65D 27/16

[52] U.S. Cl. ..... 229/73; 229/75; 229/92.7

[58] Field of Search ..... 229/73, 75, 92.1, 92.7; 206/605, 610, 632

[56] References Cited

U.S. PATENT DOCUMENTS

| | | | |
|---|---|---|---|
| 646,638 | 4/1900 | Cutler | 229/75 |
| 1,145,935 | 7/1915 | Steinke | 229/73 |
| 1,960,054 | 5/1934 | Johnson | 229/92.3 |
| 2,317,335 | 8/1939 | Whitman | 229/73 |
| 2,760,717 | 8/1956 | Wyatt | 229/73 |
| 2,984,403 | 5/1961 | David | 229/73 |
| 3,558,040 | 1/1971 | Krueger | 229/73 |
| 3,982,689 | 9/1976 | Retrum | 229/71 |
| 4,089,418 | 6/1978 | Yale | 206/632 |
| 4,194,631 | 3/1980 | Rangan | 206/610 |
| 4,332,346 | 6/1982 | Kronman | 229/73 |

*Primary Examiner*—Steven M. Pollard
*Assistant Examiner*—Bryon P. Gehman
*Attorney, Agent, or Firm*—Albert F. Kronman

[57] ABSTRACT

An envelope for two-way mailing having opposed front and rear panels secured together around three sides to provide an open edged pocket, a first flap to seal the pocket is foldably carried on the edge of the pocket by one panel. A resealing flap is carried on the edge of the pocket by the other panel. The resealing flap is inwardly folded upon its panel and disposed within the pocket during the first mailing. At least one spot of adhesive is employed to couple the resealing flap to an insert carried within the pocket. When the insert is pulled from the pocket, it automatically lifts the return flap from the pocket placing the envelope in its return mailing condition.

27 Claims, 22 Drawing Figures

FIG. 1
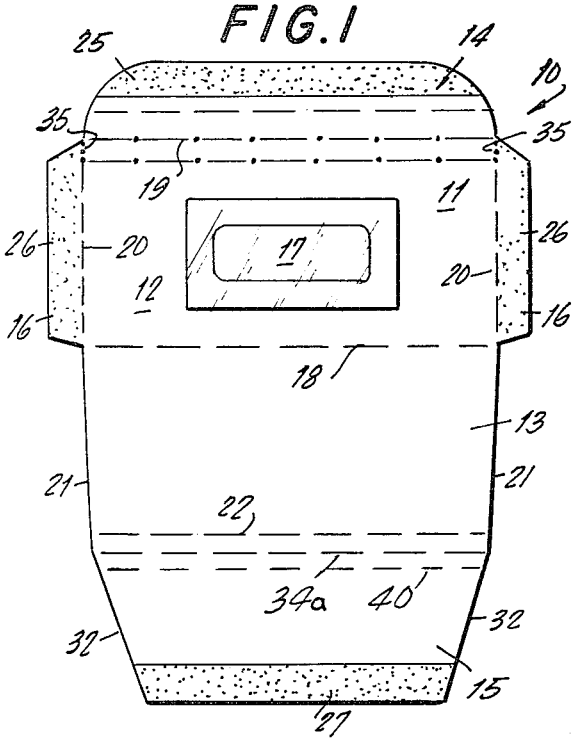
FIG. 2
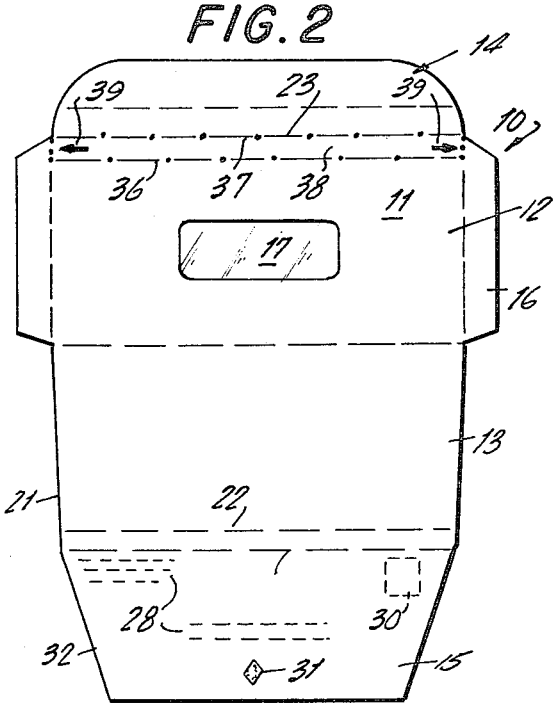
FIG. 3
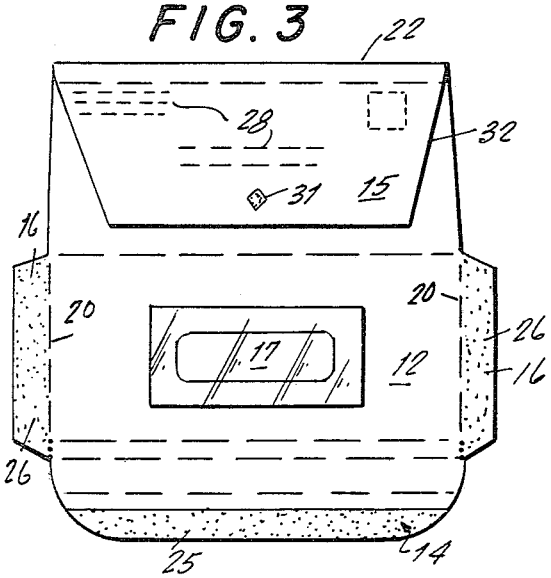
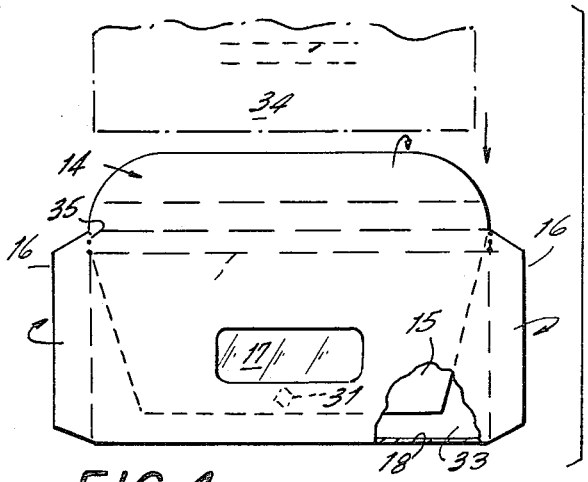
FIG. 4
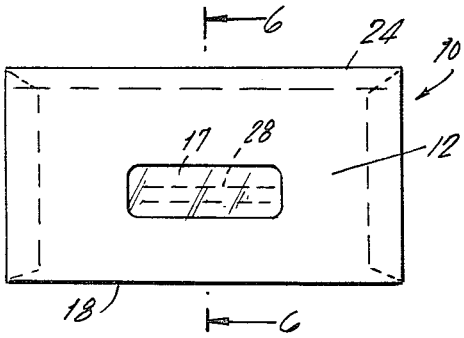
FIG. 5
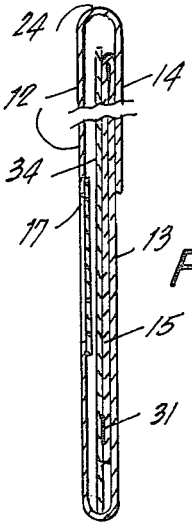
FIG. 6

FIG. 7
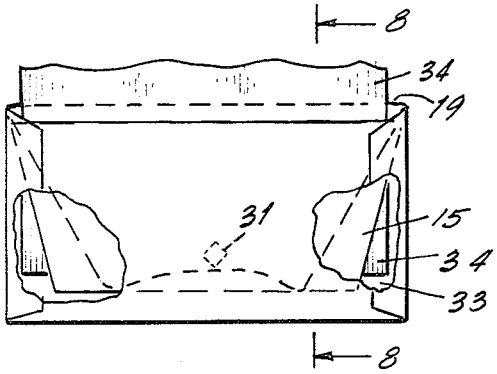
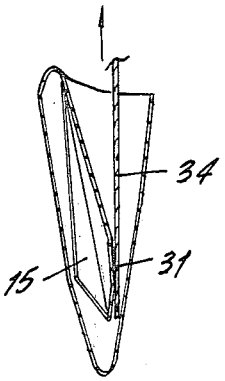
FIG. 8
FIG. 9
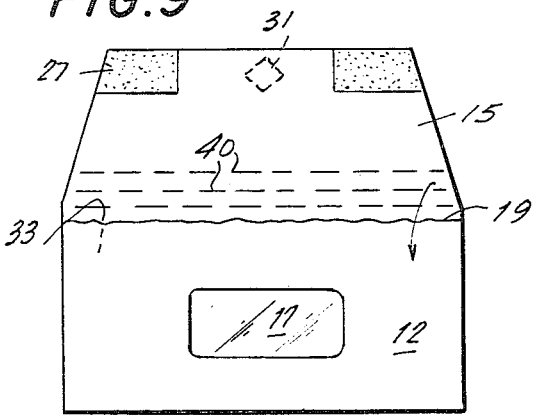
FIG. 10
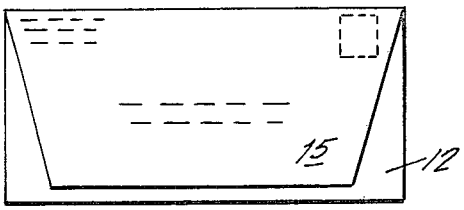
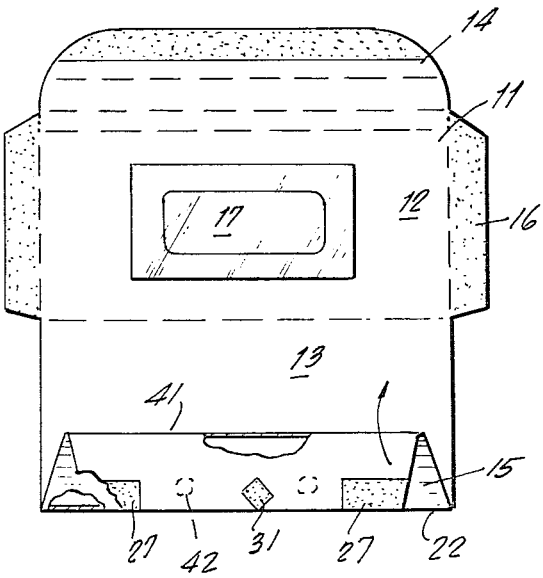
FIG. 11
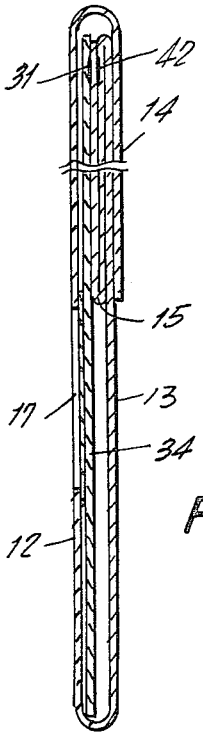
FIG. 12

FIG. 13
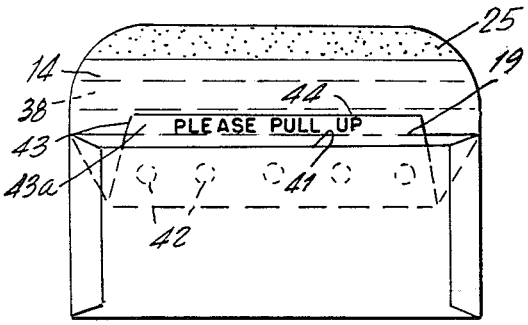
FIG. 14
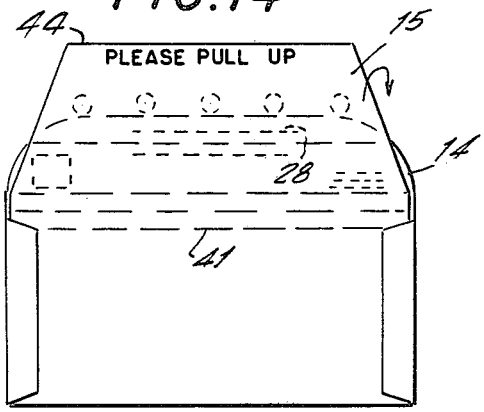
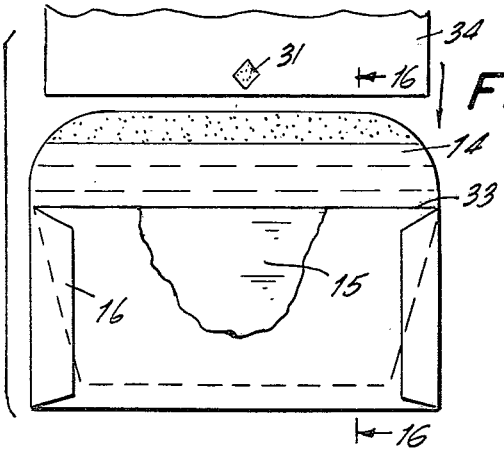
FIG. 15
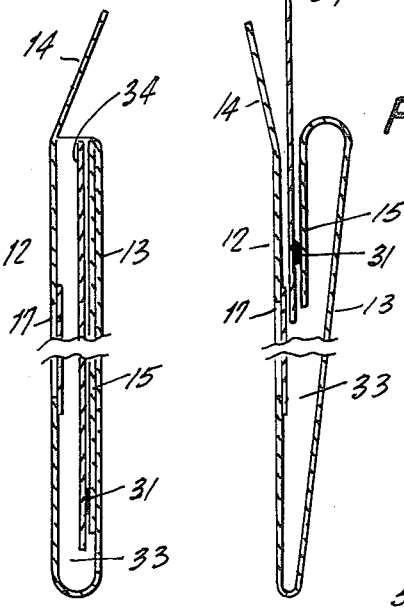
FIG. 16
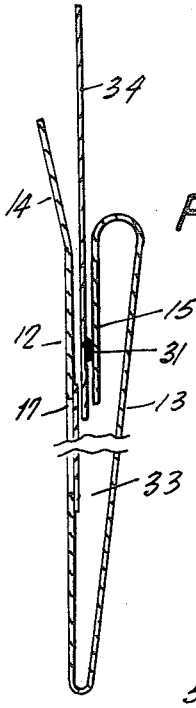
FIG. 17
FIG. 18
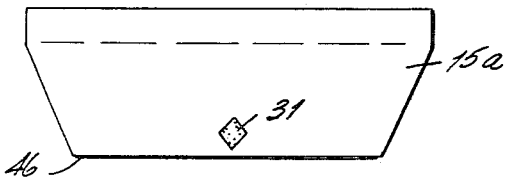
FIG. 19
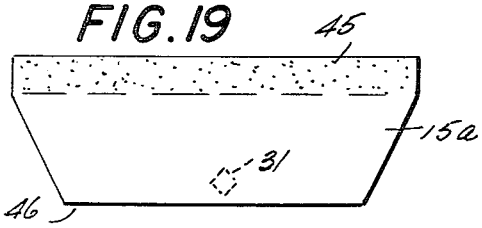
FIG. 22
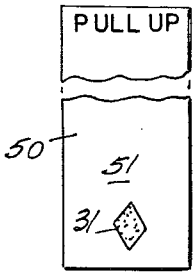
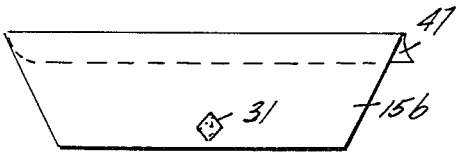
FIG. 20
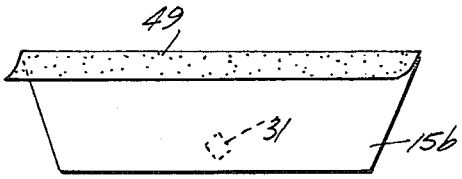
FIG. 21

TWO-WAY ENVELOPES WITH RETURN FLAP POSITIONING MEANS AND METHOD

BACKGROUND OF THE INVENTION

Two way envelopes which eliminate the need for enclosing a return envelope to facilitate replying to the original sender are well-known. The advent of the window envelope, automatic letter openers, electronic mail sorting and the use of one or more insertions of advertising material within the envelope by the original sender has made most prior art two way envelopes inadequate. Where the prior art envelopes have consisted of a large number of panels, flaps and tabs the cost of manufacture and the amount of paper used for each envelope has almost equalled, or even exceeded, the savings possible by eliminating the need for the enclosure of return envelopes in mailing pieces.

Highly complicated two way envelopes have been difficult for many recipients to master, requiring elaborate instructions printed on the outside of these envelopes together with illustrations showing how to place the envelope in condition for reuse.

In order to cover the window aperture on the front of the envelope and also any Data Processing Information that may be required by the Postal Authorities, the return flap of prior art two way envelopes such as are shown in the Steinke U.S. Pat. No. 1,145,935 must be of a length which will extend almost to the bottom of the front of the envelope when used for resealing purposes. As a result, withdrawing the return flap often causes the flap to be destroyed as it is pulled out of the envelope enclosure. Since the return flap is almost coextensive with the interior of the envelope, it is often unnoticed and the recipient fails to understand how to make a return envelope out of the opened envelope which has been received.

Accordingly, it is an object of the present invention to provide simplified two way envelopes which lend themselves to manufacture on high speed web-type envelope making machines and which overcome the disadvantages of prior art envelopes.

Another object of the present invention is to provide a two way envelope which will not be destroyed if opened in any of the customary ways by the recipient. A further object of the present invention is to provide a two way envelope which will automatically convert into its return mode by the simple action of normal opening of the envelope following its initial receipt.

A further object of the present invention is to provide a two way envelope which is compatible with window type envelopes while at the same time maintaining the security of the contents on remailing.

Still another object of the present invention is to provide two way envelopes which lend themselves to automatic insertion of enclosures and eliminate the need for enclosing self-addressed envelopes.

SUMMARY

Two way envelopes made in accordance with the present invention generally consist of a front panel, a rear panel integral with the front panel and folded together to form a pocket. Side flaps carried by either the front panel or the rear panel enclose the pocket at each end thereof by the usual adhesive attachment. The front panel is provided with a sealing flap at the upper or open edge of the envelope and the back panel is provided with a second sealing flap along its open or top edge. One sealing flap is used for the original mailing while the second sealing flap is folded into the pocket when the envelope is assembled. Thereafter, the contents to be transmitted by the envelope are placed within the pocket and the sealing flap which remains outside of the pocket is used to close the envelope. When the envelope is received, the original sealing flap is either pried open or torn from the envelope body by the recipient. As the contents of the letter are removed, coupling means interconnecting the return flap with the contents of the letter causes the return flap to be pulled out of the pocket thereby alerting the recipient to the two way capabilities of the envelope. The return flap may then be pulled over the front of the envelope and sealed to it for remailing purposes.

BRIEF DESCRIPTION OF THE DRAWINGS

In the accompanying drawings forming part hereof similar parts have been given identical reference numbers, in which drawings;

FIG. 1 is a plan view of a blank for a two way envelope according to the present invention showing the inside surface thereof.

FIG. 2 is a view similar to FIG. 1 showing the outside surface.

FIG. 3 is a view of the blank of FIG. 1 rotated 180° after the first fold in forming the two way envelope.

FIG. 4 is a view in elevation of the front of the two way envelope after the second fold in forming the envelope.

FIG. 5 is a view in front elevation of the completed two way envelope of FIGS. 1–4.

FIG. 6 is a cross sectional view, somewhat enlarged of the envelope of FIG. 5 taken on line 6–6 of FIG. 5.

FIG. 7 is a view in front elevation showing the operation of the envelope of FIGS. 1–6 as the contents are removed.

FIG. 8 is a sectional view taken on line 8—8 in FIG. 7.

FIG. 9 is a view similar to FIG. 7 showing the envelope in the return mode.

FIG. 10 is a view of the envelope of FIGS. 1–9 ready for mailing.

FIG. 11 is a plan view of the inside face of a partly formed two way envelope comprising a second embodiment of the present invention.

FIG. 12 is a cross sectional view of a completed envelope made in accordance with FIG. 11.

FIG. 13 is a view in rear elevation of a further embodiment of the present invention after the first sealing flap has been pried up exposing the return flap positioning means.

FIG. 14 is a view of the envelopes of FIG. 13 showing the return flap fully extended.

FIG. 15 is a view in elevation partly cut away taken from the back panel side of an envelope, still another embodiment of the present invention, showing the relationship of various elements before and after placement of inserts within the envelope pocket.

FIG. 16 is a cross sectional view taken on line 16–16 in FIG. 15 after the first sealing flap has been opened.

FIG. 17 is a view similar to FIG. 16 showing the manner in which the return sealing flap is pulled out of the interior of the envelope.

FIG. 18 is a view in front elevation of an envelope return flap according to the present invention.

FIG. 19 is a rear view of the flap shown in FIG. 18.

FIG. 20 is a view in front elevation of a further return envelope flap.

FIG. 21 is a rear view of the flap shown in FIG. 20.

FIG. 22 is a view in rear elevation of a coupling tab useful in the present invention.

DETAILED DESCRIPTION

Referring to the drawings and particularly to FIGS. 1–6 there is shown one embodiment of the present invention in which a two way envelope 10 is formed of a single blank of paper 11. The blank 11 contains areas which convert into a front panel 12, a back panel 13, a first and a second sealing flap 14, 15 and side flaps 16, as hereinafter more fully described.

As shown in FIG. 1, the front panel 12 may contain a window 17 of transparent material such as acetate, glassine or the like well-known in the envelope art, through which a mailing address may be viewed. The shape of the front panel is defined by a bottom fold line 18, a top fold line 19 and side fold lines 20.

The back panel 13 is defined by the common fold line 18 between the back panel and the front panel, its side margins 21 and a fold line 22 which is between the second sealing flap 15 and the said back panel. While the side flaps 16 have been shown on the front panel, it is within the purview of this invention to employ them on the back panel 13 as is well-known in the envelope art.

The first sealing flap 14 is contiguous with the front panel 12 along the fold line 19. This fold line, as hereinafter more fully described, is so located that it defines the upper edge 24 of the envelope as shown in FIGS. 5 and 6.

A strip of some suitable adhesive, indicated at 25, is provided on the first sealing flap 14 for securing the contents within the envelope on its initial use. Similar strips of adhesive are placed on the side sealing flaps 16 at 26 and a strip of adhesive is provided on the return flap 15 at 27.

FIG. 2 illustrates the front or outer surface of the blank 11 with the fold lines shown in dashed lines. The outer surface of the return flap 15 is printed with the address of the original sender as indicated by the dashed lines 28. A place for a return address 29 and a stamp 30 may also be indicated on the outer surface of the return flap 15 to aid the person initially receiving the two way envelope in recognizing the function of the return flap after the envelope has been opened for the first time.

A small spot of adhesive material 31, hereinafter more fully described, and shown as a diamond for convenience in distinguishing it from other adhesives used in the two way envelope, is carried on the outside surface of the return flap just above the free edge of said flap and midway between the side margins 32 of the said return flap. When the first step in assembling the envelope is taken, as shown in FIG. 3, the return flap 15 is folded upon fold line 22 thereby placing the said flap upon the inside surface of the back panel 13. Since the return flap, in this embodiment, must be long enough to cover the window 17 during return mailing, the spot of adhesive 31 will thus be disposed within the envelope near the bottom thereof.

The second step in assembling the envelope from the blank 11 is shown in FIG. 4. The side flaps 16 are folded along the side fold lines 20, their adhesive strips 26 moistened and the front and back panel 12, 13 secured by an outside side seam to form the pocket 33 of the envelope. An insert 34, such as a letter, bill, advertising material or the like may then be slipped into the pocket 33 and the first sealing flap 14, secured in the usual manner for mailing.

It will be seen from an examination of FIGS. 1, 2 and 3 that the distance between fold lines 18 and 22 is shorter than the distance between fold lines 18 and 19. As a result, the fold line 22 for the return flap in the assembled envelope will lie below the upper edge 24 formed by the folded first sealing flap 14. When the letter is opened, therefore, there is less chance of accidentally severing the return flap 15, which would prevent its use for return mailing. In order to permit the return flap 15 to neatly overlie the upper edge 24 of the envelope for remailing, the return flap is provided with a score line 34*a* parallel to but spaced from the fold line 22. Where the return flap 15 must cover substantially all of the front panel 12 on remailing, perforations 35, best shown in FIG. 1, may be provided at each side of the top of the front panel. By tearing these perforations the return flap 15 can be pulled down over the front panel 12 the desired distance. The first sealing flap 14 may also be made with spaced perforations 36, 37 to define a tear strip 38 indicated by spaced arrows 39. This tear strip serves the double purpose of opening the envelope without danger of damage to the return flap and at the same time lowering the top edge of the envelope to facilitate closure by the said return flap.

The assembled and sealed two way envelope ready for mailing, as best shown in FIG. 5 and in cross section in FIG. 6, places the insert 34 in contact with the outer surface of the return flap 15 and more importantly against the spot of adhesive 31. Means are then provided, depending upon the nature of the adhesive, to couple the insert to the adhesive spot 31 and thus to the return flap 15.

If the adhesive is thermoplastic heat and pressure may be applied to the outside of the envelope in the area of the adhesive 31 to couple the return flap and insert together. If the adhesive is a pressure sensitive adhesive, a suitable amount of pressure may be adequate. A two part adhesive may be employed with one of the components carried by the insert so as to come into contact with the other component on the return flap 15. Where the surface of the insert bearing against the adhesive spot 31 is an illustration or decorative, it may be important that the adhesive adhere to the return flap 15 but merely cling to the insert so that when they are separated by the addressee the insert surface is not torn or obscured FIGS. 7 and 8 show the manner in which the above described two way envelope will cause the return flap 15 to be withdrawn from the pocket 33 of the envelope. The person receiving the envelope opens it by means of a letter opener slipped under the first sealing flap, a mechanical letter opener which cuts across the top of the envelope or by use of a tear strip as previously described. If the first sealing flap 14 is pried up to open the envelope, it may be torn off along the fold line 19 or folded over the front of the envelope. The insert 34 is then grasped and pulled out of the pocket 33. As the insert is pulled upward in the manner shown in dashed lines in FIG. 7, it will lift the return flap 15 by reason of the adhesive coupling between them. The central location of the adhesive 31 will cause the return flap 15 to buckle slightly pulling its side margins away from the corners of the pocket, thereby freeing the said flap to move upward with the insert as shown in FIG. 8. As the insert and the free edge of the return flap clear the top opening of the envelope the insert and the flap will part leaving the insert in one hand and a return envelope in the other hand (see FIG. 9). Since the return flap 15 is fully extended the two way envelope has the appearance of an envelope and the printed return address provides sufficient information as to the proper manner of use. A reply can then be inserted in the pocket 33, the adhesive 27 moistened and the envelope sealed as shown in FIG. 10.

Where the paper of which the blank 11 is formed is of a stiff or heavy grade, a plurality of parallel spaced score lines 40 may be made across the return flap 15 (see FIGS. 1 and 9). The score lines 40 will impart a flexibility to the return flap 15 enabling it to roll upwardly as it is withdrawn.

FIGS. 11 and 12 illustrate a second embodiment of the present invention in which a blank 11 substantially the same as that shown in FIG. 1 is formed into a two way envelope by first folding the return flap 15 along its fold line 22 and then doubling it back upon itself along a fold line 41. In this embodiment the spot of adhesive 31 is placed on the inside surface of the return flap with the adhesive strips 27 on each side of it. When the envelope is thereafter assembled and filled in the manner hereinabove described it will have the structure shown in cross section in FIG. 12.

The embodiment of FIGS. 11 and 12 is particularly suited for envelopes where substantially the entire front of the original envelope must be covered by the return flap 15. Under such conditions the said flap has to be almost as long as the depth of the pocket 33 making it more difficult to extract when the insert is pulled out. Heavier stock envelopes also profit from this construction.

In this second embodiment, however, it may become more difficult to employ automatic envelope loading machines, (hereinafter "stuffers"). This difficulty may arise due to the additional restriction of the envelope opening caused by the additional fold of the return flap 15. It is possible to overcome this difficulty by placing one or more spots 42 of some weak adhesive such as wax between the folds to hold them in a flattened position until the return flap 15 is pulled by the insert 34 which will part the flap from the wax. In all other respects the operation of the second embodiment is the same as the first.

It is within the purview of the present invention to use the embodiment of FIGS. 11 and 12 without the adhesive spot coupling 31 as shown in FIGS. 13 and 14. In this embodiment a small projecting portion 43*a* of the return flap 15 is used as the flap positioning means. The projecting portion 43*a* is formed by folding the return flap 15 so that its free end portion 43 extends above the fold line 41. The upper edge 44 of the projecting portion will fit between the space provided by the fold line 41 and the fold line 19 of the first sealing flap. A letter opener inserted beneath the first sealing flap 14 will not cut the return flap 15 with this construction. Instructions may also be printed upon the projecting portion for positioning. Spots of wax 42 or some other weak adhesive material may also be used between the folds to reduce the amount this structure extends into the envelope pocket.

When the small projecting portion 43*a* of the return flap 15 is pulled up, the return flap will flatten out, as shown in FIG. 14, exposing the return address 28 and other features of an envelope. At this step the first sealing flap 14 may either be torn off or folded out of the way, either within the pocket 33 or over the front of the envelope. The return message or insert can then be placed in the envelope pocket and the return flap pulled over the front surface and sealed to secure the contents for remailing.

Since the entire return flap 15 is within the envelope during its initial mailing it will not become damaged or accidentally pulled out. The outstanding folded free end portion 43*a* of the return flap 15 is parallel with the travel of a letter opener and the fold 41 is below and out of the way of the point of a letter opener or mechanized letter opener.

Referring to FIGS. 15 and 16, there is shown a further embodiment of the present invention in which the insert 34 carries the adhesive spot 31. As the insert is placed within the envelope pocket 33, the adhesive spot 31 comes into contact with the outer surface of the return flap 15 as best shown in FIG. 16. Thereafter, the first sealing flap 14 is moistened and sealed in the well-known manner. The sealed envelope is passed beneath a station (not shown) in which heat or pressure or both is applied to the outside of the envelope to cause the adhesive spot 31 to adhere to the return flap 15 and thereby couple the insert to the return flap at this point.

When the envelope is received and the first sealing flap 15 slipped open, as shown in FIG. 17, the insert 34 is lifted upwardly pulling with it the return flap 15 until the return flap is substantially withdrawn from the pocket 33 of the envelope. Continued pulling on the part of the recipient will separate the insert 34 from the return flap 15 to provide an envelope for the return trip.

It is within the purview of the present invention to convert an ordinary envelope into a two way envelope by means of a return flap which is initially a separate piece of paper from the envelope blank and which is secured to the inside rear upper portion of the envelope adjacent the open end of the pocket 33. Return flaps suitable for this purpose are shown in FIGS. 18–21.

Referring to FIGS. 18 and 19, there is shown an envelope return flap 15*a* consisting of a single foil having a shape of an envelope flap. A small spot of adhesive 31 is provided on the front face of the said flap and a strip of adhesive 45 is provided along the upper rear margin of the flap as shown in FIG. 19. The spot of adhesive 31 is disposed adjacent the lower margin 46 of the flap 15*a*. The flap 15*a* may be placed within the pocket 33 of the envelope by means of the stuffer (inserting machine) on top of the last insert 34 and the envelope then sealed. The application of heat or pressure or the like to the outside rear surface of the envelope will then cause the adhesive 45 to attach the flap 15*a* along the inner margin of the envelope so that the return flap is now carried within the pocket 33 of the envelope. At the same time, the spot of adhesive 31 will be activated to couple the insert to the flap 15*a*. The resulting envelope can then be used as a two way envelope in the same manner as has been previously described. In using the flap 15*a* it may be desirable to provide the perforations 35 shown in FIG. 1 so that the top edge of the front panel 12 can be brought down to permit the flap 15*a* to be brought over the front panel more easily for sealing purposes.

The return flap 15*b* shown in FIGS. 20 and 21 is similar to the flap 15*a* except that the upper portion of the flap is folded back upon itself as indicated at 47 to form a hinge 48 which is provided with a strip of adhesive 49 as best shown in FIG. 21. In this embodiment the adhesive 49 and the adhesive spot 31 are applied on the same side of the sheet so that when the flap 15*b* is inserted within the envelope, as previously described in connection with FIGS. 18 and 19, the adhesive 49 will be in contact with the inner surface of the back panel 13 adjacent the open edge thereof and the adhesive spot 31 will face the insert 34. The hinge 48 facilitates bringing the flap 15*b* over the front panel for resealing purposes. In all other respects, the application, the adhesion and sealing of flap 15*b* is the same as that described above in connection with flap 15*a*.

Instead of applying the spot of glue 31 to the insert 34 as described in connection with FIGS. 15, 16 and 17, it is possible to provide a coupling tab 50 as shown in FIG. 22 which is placed within the envelope pocket 33 by means of a stuffer. The coupling tab 50 consists of an elongated strip 51 near the bottom of which there is carried the spot of glue 31. Instructions such as the words "pull-up" are imprinted at the top of the strip. The coupling tab 50 is placed within the pocket 33 of the envelope so that the adhesive spot 31 is disposed in contact with the return flap 15 and the top of the strip extends slightly above the fold line 41 in the manner shown in FIG. 13 and in the same position as the free end portion 43*a*. Thereafter, the above described sealing process will include heating the adhesive spot 31 so as to adhere it to the return flap 15. The coupling tab 50 will be withdrawn by the recipient, in the same manner that the insert 34 was in FIG. 17, to slip the return flap out of the pocket 33 of the envelope.

The adhesive spot 31 useful in the invention preferably has certain desirable characteristics. The adhesive spot 31 hereinafter described is selected to provide a no-tear bond to the surface of the insert so that when the insert is pulled free of the return flap 15, the printed or ornamental surface of the insert is not impaired. Such adhesives are characterized as low pull strength adhesives. In addition, the adhesives should have a high internal cohesive strength. Adhesives of this type, may be found among hot melt, aqueous systems, or solvent system adhesives. A hot melt system of this type usually is characterized by high crystallinity. Thus, the adhesive spot 31 can be applied to the return flap, and thereafter again activated just before the envelope is sealed for the first time to couple it to the insert in such a manner that the desired low peel strength can be obtained. In the embodiment of FIG. 22, however, since the strip 50 does not contain any printed or decorative material, the requirement for a different type of bond between the strip 50 and the return flap is not essential.

Having thus fully described the invention what is desired to be secured by Letters Patent and claimed is:

1. An envelope for two-way mailing formed from a one piece blank having substantially rectangular front and rear panels interconnected along three edges to provide a pocket, and an insert for transmittal therein receivable within said pocket between the unconnected panel edges of the pocket comprising a first sealing flap carried by and integral with one of said unconnected edges, a second return sealing flap carried by and integral with the other unconnected edge, said second return sealing flap being folded inwardly along the unconnected panel edge of its supporting panel to extend within the pocket and overlie said supporting panel and means including at least one spot of adhesive to couple the return sealing flap to the insert whereby the inwardly folded return sealing flap is withdrawn from the pocket to its upright return sealing position when the insert is removed from the pocket.

2. An envelope according to claim 1 in which the spot of adhesive is disposed on the outside surface of the return sealing flap and spaced from the free edge thereof.

3. An envelope according to claim 2 in which the spot of adhesive is disposed substantially midway between the side margins of the return sealing flap.

4. An envelope according to claim 2 in which the coupling means includes an elongated slip inserted adjacent the second resealing flap.

5. An envelope according to claim 4 in which the spot of adhesive is carried by the elongated slip.

6. An envelope according to claim 1 in which the spot of adhesive is a low pull strength adhesive having a high internal cohesive strength.

7. An envelope according to claim 6 in which the spot of adhesive is an aqueous system adhesive.

8. An envelope according to claim 6 in which the spot of adhesive is a solvent system adhesive.

9. An envelope according to claim 6 in which the spot of adhesive is a hot melt adhesive having high crystallinity.

10. An envelope according to claim 1 in which the return sealing flap is substantially coextensive with the front panel in area.

11. An envelope according to claim 6 in which the adhesive is a hot melt adhesive.

12. An envelope according to claim 1 in which the first sealing flap is defined by a first fold line between the said first sealing flap and the front panel, said front panel being perforated at each side thereof for a short distance in the direction of the pocket, whereby the width of the front panel may be reduced prior to resealing.

13. An envelope according to claim 12 in which the first fold line is scored to facilitate the removal of the first sealing flap from the envelope prior to resealing.

14. An envelope according to claim 13 in which a second score line is provided parallel to and spaced from the first fold line, inwardly spaced from the first fold line and transverse of the front panel to form with said first fold line a tearing strip across the envelope.

15. An envelope according to claim 1 in which the second return sealing flap is defined by a second fold line between the second return sealing flap and the rear panel and the width of the rear panel so defined is less than the width of the front panel.

16. An envelope according to claim 15 in which the second return sealing flap is provided with a plurality of parallel scored fold lines spaced from and parallel to the second fold line.

17. An envelope according to claim 1 in which the second return sealing flap is doubled back upon itself before being folded inwardly and the spot of adhesive is disposed on the inside surface of the return sealing flap and spaced from the free edge thereof.

18. An envelope according to claim 1 in which the spot of adhesive is carried by the insert and coupled to the second resealing flap within the pocket.

19. An envelope according to claim 1 in which the spot of adhesive is formed of a two part system, one part of which is carried by the insert and the other part by the second resealing flap, said parts being in register with each other to effect a bond between the insert and the said flap within the pocket.

20. An envelope for two-way mailing formed from a one piece blank having substantially rectangular front and rear panels interconnected along three edges to provide a pocket, and an insert for transmittal therein receivable within said pocket between the unconnected panel edges of the pocket comprising a first sealing flap carried by and integral with one of said unconnected edges, a second return sealing flap carried by the other unconnected edge, said second return sealing flap being adhesively secured inwardly along the unconnected panel edge of its supporting panel to extend within the pocket and overlie said supporting panel and means including at least one spot of adhesive to couple the return sealing flap to the insert whereby the inwardly folded return sealing flap is withdrawn from the pocket to its upright return sealing position when the insert is removed from the pocket.

21. An envelope according to claim 20 in which the spot of adhesive is disposed on the outside surface of the return sealing flap and spaced from the free edge thereof.

22. An envelope according to claim 20 in which the return resealing flap is plannar and the spot of adhesive is disposed substantially midway between the side margins of the return resealing flap.

23. An envelope according to claim 20 in which the return resealing flap is folded to form a hinged portion for attachment to the rear panel and the spot of adhesive is disposed on the inside surface of said flap.

24. The method of preparing a two-way envelope containing an insert for initial mailing said envelope formed of a one piece blank having substanitally rectangular front and rear panels meeting along a common fold line, a first sealing flap on the front panel at one end of the blank, a second resealing flap on the rear panel at the opposite end of the blank, side flaps integral with one of said panels, adhesive material carried by the inside margins of the first, second and side flaps, and at least one spot of adhesive carried by the outside surface of the second resealing flap comprising the steps of folding the second resealing flap inwardly to overlie the rear panel, folding the rear panel inwardly to bring the second resealing flap into position between the said front and rear panels, activating the adhesive on the side flaps, folding said side flaps about the opposed panel to form an envelope pocket, placing an insert within the pocket, and activating the adhesive spot to couple the insert to the second resealing flap.

25. The method of claim 24 in which the adhesive spot is activated by the heat applied externally of the envelope.

26. The method of claim 24 in which the adhesive spot is activated by pressure applied externally of the envelope.

27. The method of claim 24 in which the adhesive spot is activated by an activating material carried by the insert.

* * * * *